US011098883B2

(12) United States Patent
Zeng et al.

(10) Patent No.: US 11,098,883 B2
(45) Date of Patent: Aug. 24, 2021

(54) LAMP BASE WITH ADJUSTABLE ILLUMINATION ANGLE

(71) Applicant: XIAMEN ECO LIGHTING CO. LTD., Xiamen (CN)

(72) Inventors: Maojin Zeng, Xiamen (CN); Qiqing Yu, Xiamen (CN); Zhenkun Huang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/596,521

(22) Filed: Oct. 8, 2019

(65) Prior Publication Data

US 2021/0102690 A1 Apr. 8, 2021

(51) Int. Cl.

| | |
|---|---|
| ***F21V 21/30*** | (2006.01) |
| ***F21S 8/02*** | (2006.01) |
| ***F21V 21/04*** | (2006.01) |
| ***F21V 14/02*** | (2006.01) |
| ***F21V 17/02*** | (2006.01) |
| ***F21Y 115/10*** | (2016.01) |

(52) U.S. Cl.

CPC ..... *F21V 21/30* (2013.01); *F21S 8/026* (2013.01); *F21V 14/02* (2013.01); *F21V 17/02* (2013.01); *F21V 21/04* (2013.01); *F21Y 2115/10* (2016.08)

(58) Field of Classification Search

CPC ..... F21V 21/30; F21V 14/02; F21V 17/02; F21V 21/04; F21S 8/026; F21Y 2115/10

USPC ..... 362/287

See application file for complete search history.

(56) References Cited

U.S. PATENT DOCUMENTS 6,554,457 B1 * 4/2003 Platt ..... F21V 19/04 362/269

* cited by examiner

*Primary Examiner* — Andrew J Coughlin
*Assistant Examiner* — Jessica M Apenteng
(74) *Attorney, Agent, or Firm* — Chun-Ming Shih; Lanway IPR Services

(57) ABSTRACT

A lamp base includes a lamp body, a ring frame and a circumferential projection component. The lamp body includes an illuminating component, a ring frame and a circumferential projection component. The ring frame surrounds the lamp body. Such that the lamp body is seated within the ring frame. The ring frame also rotates relative to the lamp body along a rotational axis of the lamp base. The circumferential projection component has an inner circular through hole to allow the lamp body to pass through. The circumferential projection component detachably and rotatably engages with the ring frame. The lamp body rotates relative to at least one of the ring frame and the circumferential projection component along the rotational axis, so as to adjust an illumination angle of the illuminating component.

44 Claims, 11 Drawing Sheets

LAMP BASE WITH ADJUSTABLE ILLUMINATION ANGLE

BACKGROUND OF THE INVENTION

1. Field of the Invention

The present invention relates to a lamp base for a downlight, and more particularly, a lamp base with an adjustable illumination angle.

2. Description of the Prior Art

A conventional downlight is embedded onto a ceiling for illuminating downwards. In this way, the conventional downlight requires a smaller volume for installation. In addition, the conventional downlight can acquire different illumination effects by applying various reflectors, such as a mirror, a shutter, or a decoration lamp. However, the conventional downlight has a highly fixed illuminating orientation, i.e., illumination angle. Such that the conventional downlight is still significantly limited in its illumination effects.

SUMMARY OF THE INVENTION

The present invention aims at neutralizing the limitation on a conventional downlight's illumination effects. For achieving such goal, the present invention discloses a lamp base for a downlight with adjustable illumination angle.

According to a first embodiment of the present invention, the disclosed lamp base includes a lamp body, a ring frame and a circumferential projection component. The lamp body includes an illuminating component, a ring frame and a circumferential projection component. The ring frame surrounds the lamp body. Such that the lamp body is seated within the ring frame. The ring frame also rotates relative to the lamp body along a rotational axis of the lamp base. The circumferential projection component has an inner circular through hole to allow the lamp body to pass through. The circumferential projection component detachably and rotatably engages with the ring frame. The lamp body rotates relative to at least one of the ring frame and the circumferential projection component along the rotational axis, so as to adjust an illumination angle of the illuminating component.

In one example, the ring frame includes a ring body, a first flexible connector and a second flexible connector. The first flexible connector is coupled to the ring body at a perimeter of the ring frame. The second flexible connector is coupled to the ring body at the perimeter of the ring frame and opposite to the first flexible connector. The circumferential projection component includes a circular sidewall and a ring projection. The circular sidewall forms the inner circular through hole and stands along the rotational axis. The ring projection extends circumferentially from the circular sidewall. Both the first flexible connector and the second flexible connector are configured to detachably and rotatably engage with the lamp body. The ring body rotatably and detachable engages with the circular sidewall. The lamp body further rotates relative to at least one of the circular sidewall and both the first flexible connector and the second flexible connector for adjusting the illumination angle.

In one example, the lamp body and the circular sidewall form a gap in between.

In one example, both the first flexible connector and the second flexible connector clamp the lamp body. Such that a friction force is generated between the ring frame and the lamp body when the ring frame rotates relative to the lamp body along the rotational axis.

In one example, both the first flexible connector and the second flexible connector further stop the ring frame from rotating relative the lamp body along the rotational axis using the friction force.

In one example, the ring body further forms a friction force or a clamp force with the circular sidewall for stopping the ring body from relatively rotating with the circular sidewall.

In one example, both the first flexible connector and the second flexible connector are integrated with the ring body. Such that the ring frame forms an integral structure.

In one example, each of the first flexible connector and the second flexible connector includes a through hole. The lamp body further includes at least one affixation hole respectively corresponding to each the through hole of the first flexible connector and the second flexible connector. The lamp base further includes at least one fastener corresponding to each of the affixation hole and each of the through hole. Each of the at least one fastener detachably affixes to a corresponding affixation hole or a corresponding through hole. Such that a swing angle of the lamp body along a swing axis extending from a straight line between the first flexible connector and the second flexible connector is adjustable.

In one example, the at least one fastener includes at least one screw. The at least one affixation hole includes at least one screw receiving hole. The at least one screw screws into the at least one screw receiving hole to forma screw engagement between the lamp body and the first flexible connector or the second flexible connector.

In one example, the at least one fastener is integrated with the lamp body.

In one example, each of the at least one fastener further detachably affixes to the corresponding affixation hole and the corresponding through hole via an interference fit.

In one example, the at least one affixation hole is disposed at a lower part of the lamp body.

In one example, the lamp body further includes at least one rotation limiter. The at least one rotation limiter abuts the first flexible connector or the second flexible connector for limiting a relative rotation between the ring frame and the lamp body.

In one example, each of the at least one rotation limiter comprises a frontside projection and a backside projection. The frontside projection limits the relative rotation between the ring frame and the lamp body in a clockwise manner or in a counterclockwise manner. The backside projection limits the relative rotation between the ring frame and the lamp body in an opposite manner to that of the frontside projection.

In one example, a distance between the frontside projection and the backside projection is determined according to a desired rotational range of the lamp body relative to the ring frame.

In one example, the frontside projection and the backside projection shares a same geometric form.

In one example, both the frontside projection and the backside projection are pillar-formed.

In one example, the frontside projection includes a first cross section. The first cross section abuts the first flexible connector or the second flexible connector. The backside projection includes a second cross section. The second cross section abuts the first flexible connector or the second flexible connector.

In one example, the first cross section and the second cross section share a same geometric form.

In one example, both the first cross section and the second cross section are circular or rectangular.

In one example, the ring frame further includes a third flexible connector and a fourth flexible connector. The third flexible connector is coupled to the ring body at the perimeter of the ring frame. The fourth flexible connector is coupled to the ring body at the perimeter of the ring frame and opposite to the third flexible connector. a first straight line that links the first flexible connector and the second flexible connector is substantially orthogonal to a second straight line that links the third flexible connector and the fourth flexible connector. Both the third flexible connector and the fourth flexible connector detachably engage with the circular sidewall. Such that the ring frame rotatably and detachably engages with the circumferential projection component.

In one example, both the third flexible connector and the fourth flexible connector further clamp the circular sidewall for rotatably and detachably engaging the ring frame with the circular sidewall.

In one example, each of the third flexible connector and the fourth flexible connector includes a through hole. The lamp body further includes at least one affixation hole respectively corresponding to each the through hole of the third flexible connector and the fourth flexible connector. The lamp base further includes at least one fastener corresponding to each of the affixation hole and each of the through hole. Each of the at least one fastener detachably affixes to a corresponding affixation hole and a corresponding through hole. Such that a swing angle of the lamp body along a swing axis extended from the second straight line is adjustable.

In one example, the at least one fastener includes at least one screw. The at least one affixation hole includes at least one screw receiving hole. The at least one screw screws into the at least one screw receiving hole to forma screw engagement between the lamp body and the third flexible connector or the fourth flexible connector.

In one example, the at least one fastener is integrated with the lamp body.

In one example, each of the at least one fastener further detachably affixes to the corresponding affixation hole and the corresponding through hole via an interference fit.

In one example, the lamp body further includes at least one rotation limiter. The at least one rotation limiter abuts the third flexible connector or the fourth flexible connector for limiting a relative rotation between the ring frame and the lamp body.

In one example, each of the at least one rotation limiter includes a frontside projection and a backside projection. The frontside projection limits the relative rotation between the ring frame and the lamp body in a clockwise manner or in a counterclockwise manner. The backside projection limits the relative rotation between the ring frame and the lamp body in an opposite manner to that of the frontside projection.

In one example, a distance between the frontside projection and the backside projection is determined according to a desired rotational range of the lamp body in relative to the ring frame.

In one example, the frontside projection and the backside projection shares a same geometric form.

In one example, both the frontside projection and the backside projection are pillar-formed.

In one example, the frontside projection includes a first cross section. The first cross section abuts the third flexible connector or the fourth flexible connector. The backside projection includes a second cross section. The second cross section abuts the third flexible connector or the fourth flexible connector.

In one example, the first cross section and the second cross section share a same geometric form.

In one example, both the first cross section and the second cross section are circular or rectangular.

In one example, the lamp body further includes an upper part, a lower part, a middle part, a lampshade and a circuit board. The illuminating component extends from the upper part. The lower part supports the upper part. The middle part is sandwiched between the upper part and the lower part and supported by the lower part. The lampshade is installed within the middle part. The lampshade covers the illuminating component. Such that the lampshade reflects part of illuminance emitted from the illuminating component. The circuit board is installed within the lampshade and electrically coupled to the illuminating component for driving the illuminating component.

In one example, the upper part, the lower part, and the middle part are coupled with each other via one of a snap fit, a threaded fit, an interference fit, a tongue-and-groove fit, a post-and-bore fit, and a press fit.

In one example, the lamp base further includes at least one flexible installer. The at least one flexible installer is oppositely disposed on the circular sidewall for fastening the circumferential projection component onto an external surface.

In one example, the lamp base further includes a fastener plate. The fastener plate affixes the at least one flexible installer into the circular sidewall via one of a snap fit, a threaded fit, an interference fit, a tongue-and-groove fit, a post-and-bore fit, and a press fit.

In a second embodiment, the ring frame includes a ring body and a first blocker. The first blocker is disposed a perimeter of the ring body. The circumferential projection component includes a circular sidewall and a ring projection. The ring body is disposed above the circular sidewall. The circular sidewall includes a second blocker disposed internally on a perimeter of the circular sidewall. The ring projection extends circumferentially from the circular sidewall. The ring body rotatably and detachably engages with the circular sidewall. The relative rotation between the ring body and the circular sidewall along the rotational axis is blocked when the first blocker abuts the second blocker during the relative rotation.

In one example, the lamp body and the circular sidewall form a gap in between.

In one example, the ring body and the circular sidewall generate a friction force in between when the ring body rotates relatively to the circular sidewall.

In one example, the circumferential projection component further includes at least three lateral blockers. The at least three lateral blockers are disposed on the perimeter of the circular sidewall. Also, the at least three lateral blockers fix an orthogonal center line of the ring body to stay aligned with the rotational axis.

In one example, the circumferential projection component further includes at least two vertical blockers. The at least two vertical blockers are disposed above the ring body and configured to block the ring body from moving along the rotational axis.

In one example, the lamp base further includes a fastener plate. The fastener plate affixes the at least two vertical blockers into the circular sidewall via one of a snap fit, a threaded fit, an interference fit, a tongue-and-groove fit, a post-and-bore fit, and a press fit.

In one example, the lamp base further includes a fastener plate. The fastener plate affixes the at least two vertical blockers into the circular sidewall by integrating with the at least two vertical blockers.

These and other objectives of the present invention will no doubt become obvious to those of ordinary skill in the art after reading the following detailed description of the preferred embodiment that is illustrated in the various figures and drawings.

DETAILED DESCRIPTION

As mentioned above, the present invention discloses a lamp base for a downlight with an adjustable illumination angle.

Figure 1:
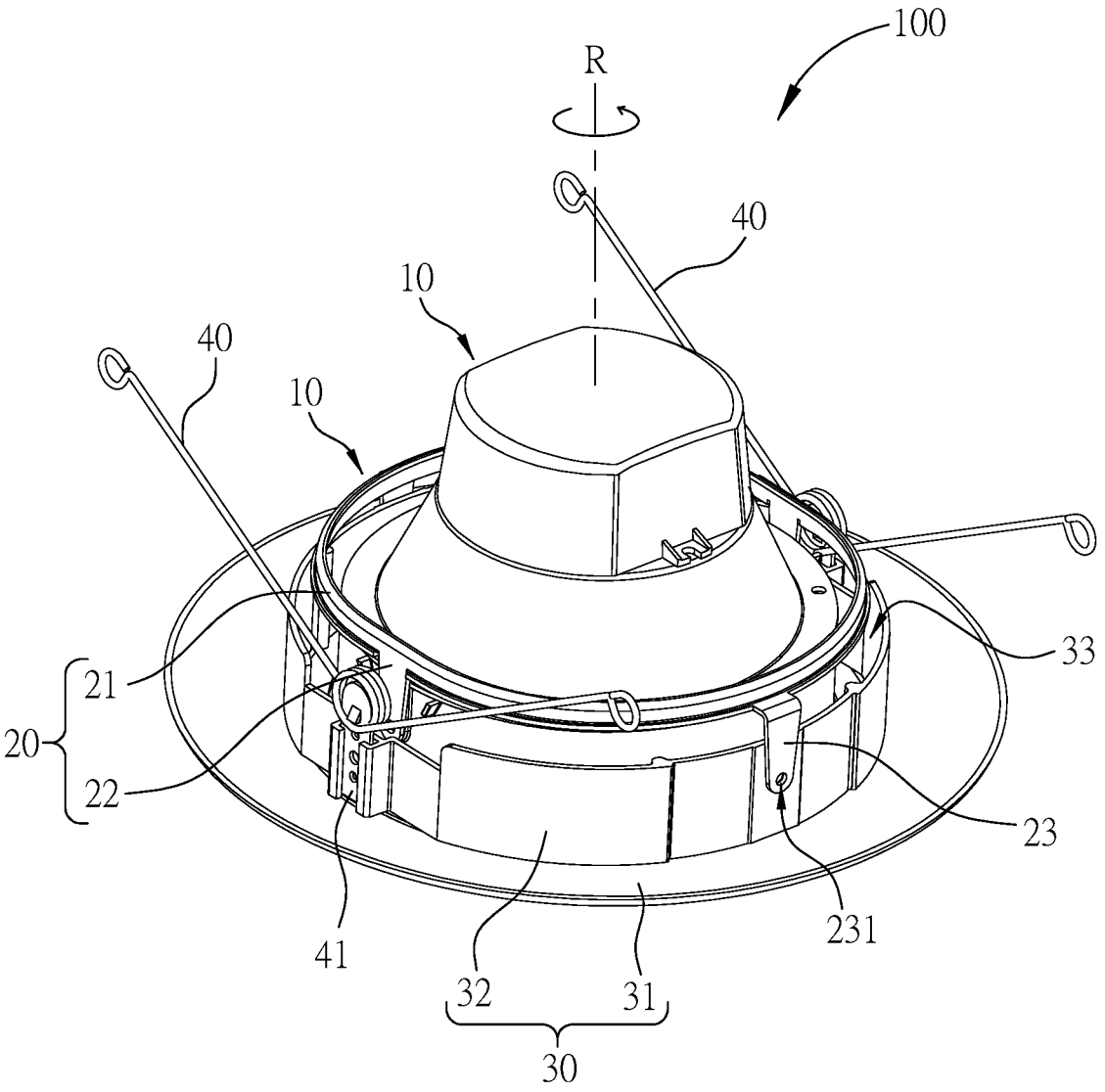
FIG. 1 illustrates a stereogram of a lamp base according to a first embodiment of the present invention.
Figure 2:
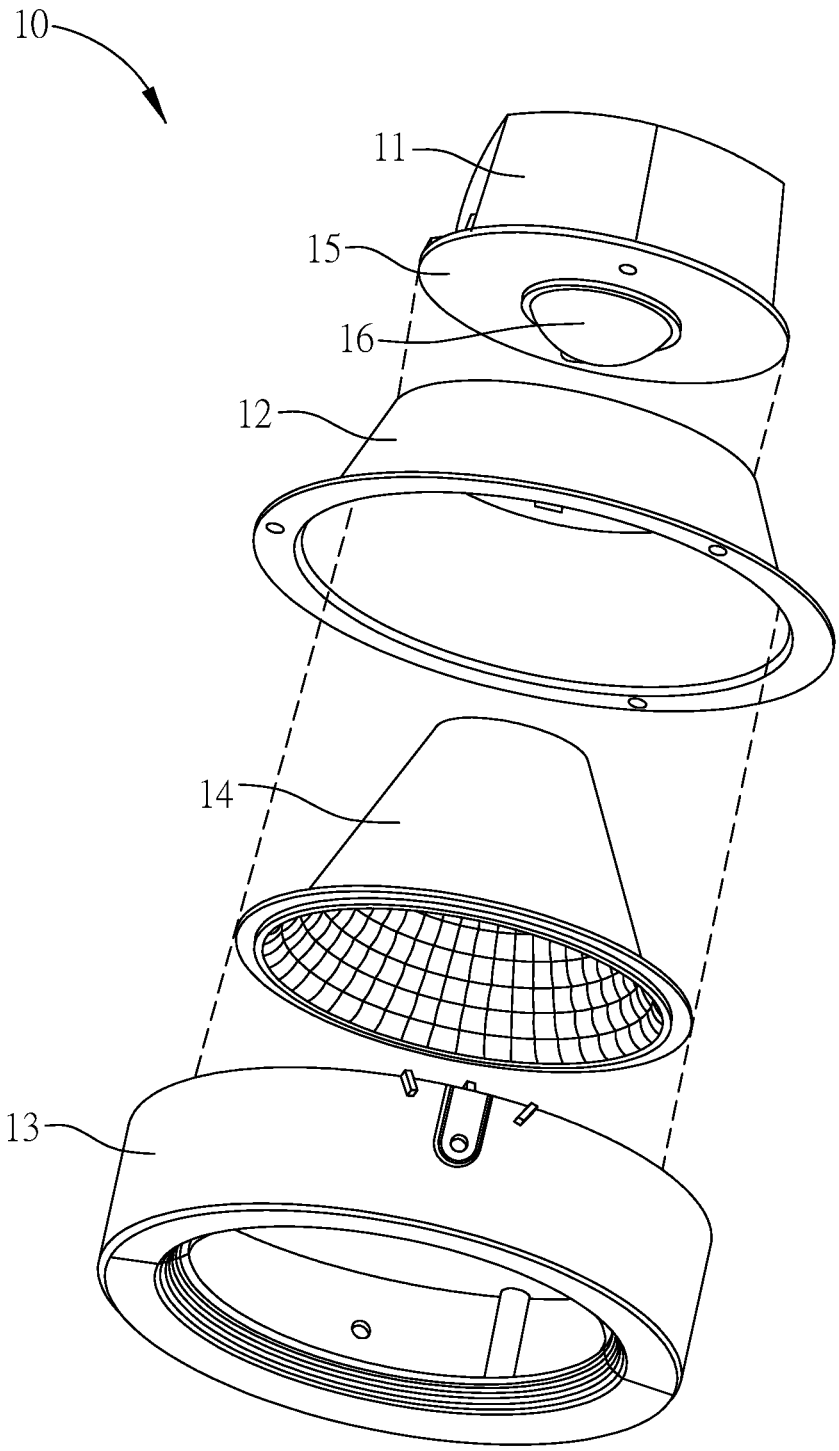
FIG. 2 illustrates a detailed diagram of the lamp body shown in FIG. 1.
Figure 3:
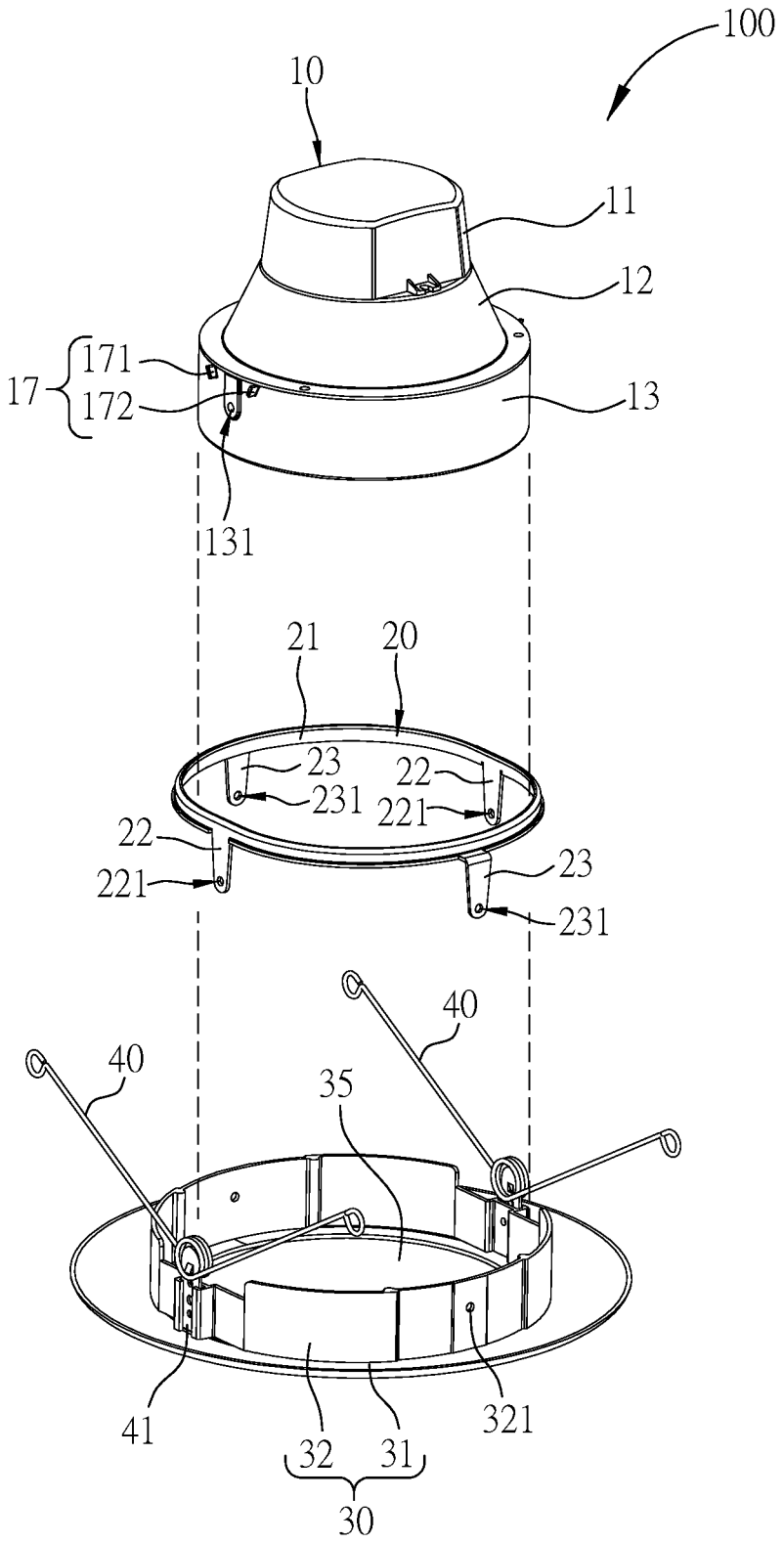
FIG. 3 illustrates a split diagram of the lamp base shown in FIG. 1.
Figure 4:
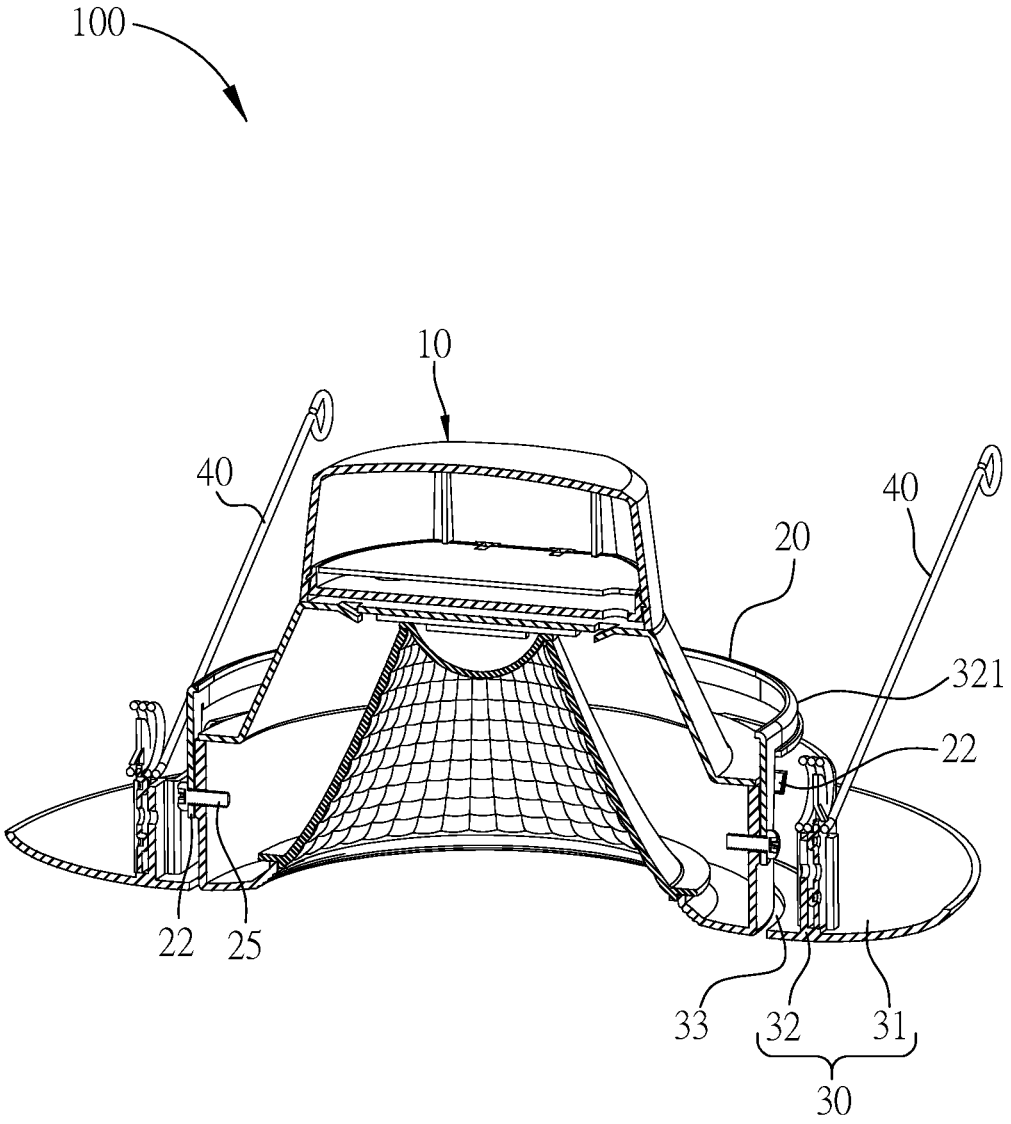
FIG. 4 illustrates a perspective diagram of the lamp base shown in FIG. 1.
Figure 5:
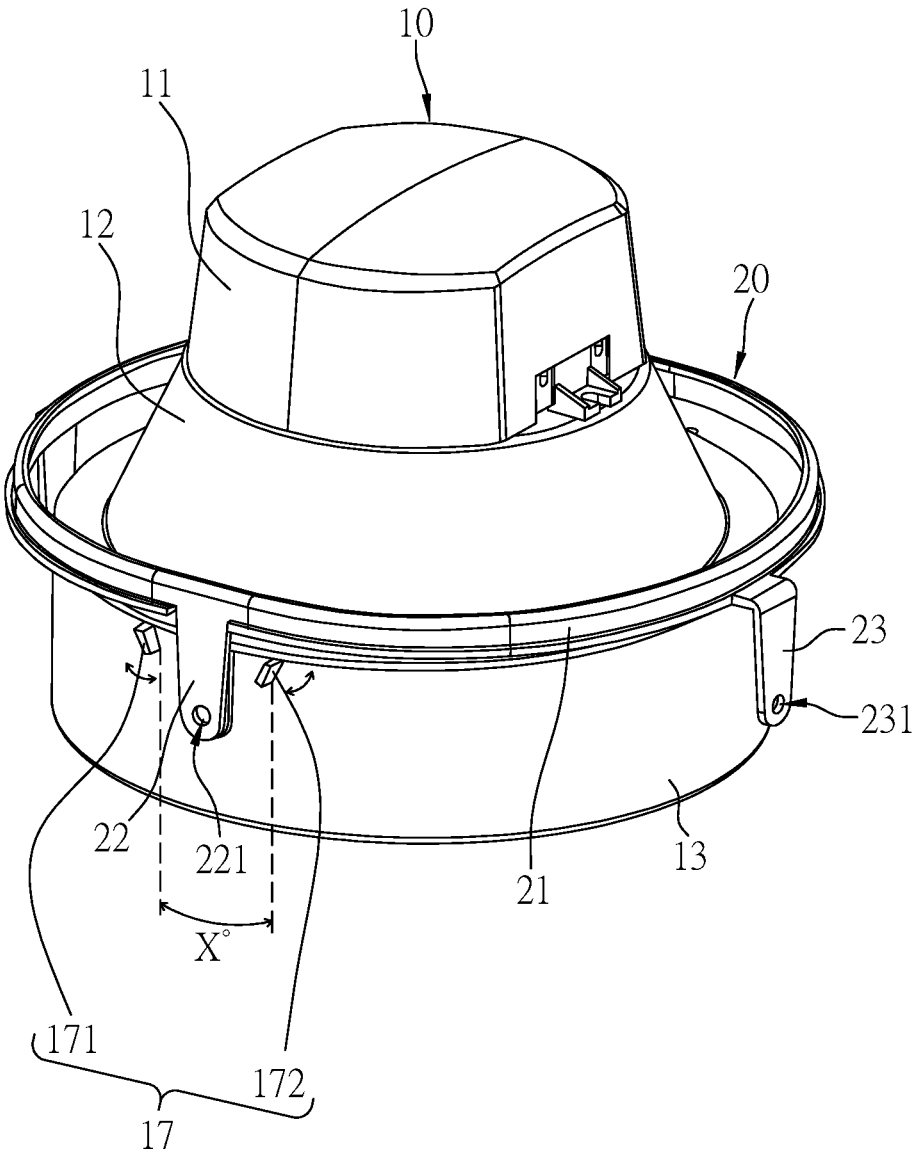
FIG. 5 illustrates a more detailed diagram of the lamp base with respect to that of FIG. 1.
Figure 6:
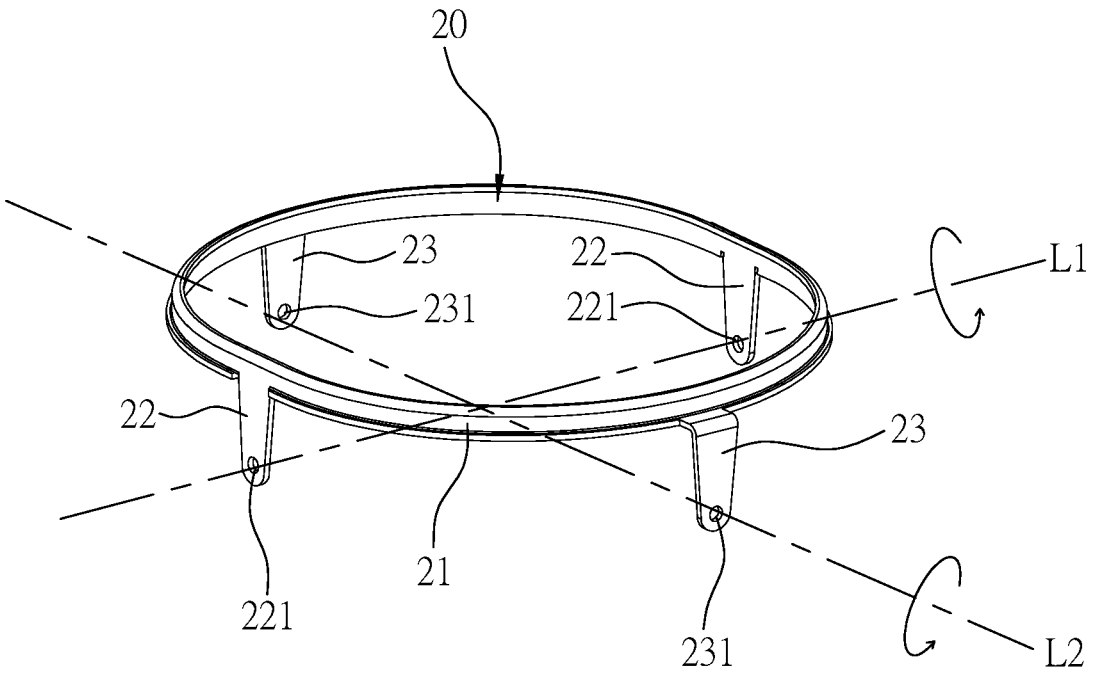
FIG. 6 illustrates exemplary swing movement of the ring frame shown in FIG. 1 relatively to the lamp body shown in FIG. 1.

FIGS. 1-6 illustrate a lamp base 100 for a downlight according to a first embodiment of the present invention. Specifically, FIG. 1 illustrates a stereogram of the lamp base 100, which includes a lamp body 10, a ring frame 20 and a circumferential projection component 30. FIG. 2 illustrates a detailed diagram of the lamp body 10. FIG. 3 illustrates a split diagram of the lamp base 100. FIG. 4 illustrates a perspective diagram of the lamp base 100. FIG. 5 illustrates a more detailed diagram of the lamp base with respect to that of FIG. 1. FIG. 6 illustrates exemplary swing movement of the ring frame 20 relatively to the lamp body 10.

The lamp base 10 includes an illuminating component 16 disposed below, as shown in FIG. 2.

The ring frame 20 surround the lamp body 10 such that the lamp body 10 seated within the ring frame 20. Also, the ring frame 20 rotates relative to the lamp body 10 along a rotational axis R of the lamp base 100, either clockwise or counterclockwise.

The circumferential projection component 30 has an inner circular through hole 35 to allow the lamp body 10 to pass through. Also, the circumferential projection component 30 detachably and rotatably engages with the ring frame 20.

In one example, the ring frame 20 includes a ring body 21 and at least two flexible connectors 22 or 23. That is, in a first example, the ring frame 20 may apply at least two flexible connectors 22 disposed oppositely; in a second example, the ring frame 20 may apply both at least two flexible connectors 22 disposed oppositely and at least two flexible connectors 23 disposed oppositely. The at least two flexible connectors 22 and 23 are disposed at a perimeter of the ring frame 20 and opposite to each other for the ring frame 20's balance. Also, the at least two flexible connectors 22 and 23 detachably and rotatably engage with the lamp body 10.

In one example, the circumferential projection component 30 includes a circular sidewall 32 and a ring projection 31. The circular sidewall 32 forms the inner circular through hole 35 and stands along the rotational axis R. And the ring projection 31 extends circumferentially from the circular sidewall 32. In one example, the lamp body 10 and the circular sidewall 32 form a gap 33 in between for a relative movement, e.g., a relative rotation.

In one example, the ring body 21 optionally rotates relative to the circular sidewall 32.

In one example, the lamp body 10 optionally rotates relative to the circular sidewall 32 and/or the at least two flexible connectors 22 and 23 for adjusting the lamp base 100's illumination angle.

In some examples, the circumferential projection component 30 is used for coupling to an installation disposed on the ceiling, such that the lamp base 100 for the downlight can be fixed onto the ceiling. Also, the lamp body 10 illuminates itself downwards with the aid of its illuminating component. In addition, with the at least two flexible connectors 22 and 23 that are coupled to the ring body 21 and detachably engaged with the lamp body 10, the ring body 21 is capable of rotating relative to the lamp body 10 along at least two different lateral swing axes L1 and L2 as shown in FIG. 6, for example, by a user who pushes the ring body 21. In this way, the user can adjust the lamp base 100's illumination angle along the lateral swing axis L1 or L2. Optionally, when the ring body 21, which is coupled to the at least two flexible connectors 22 and 23, rotates relative to the circular sidewall 32, the lamp body 10, which is engaged with the at least two flexible connectors 22 and 23, can also rotate relative to the circular sidewall 32. In this way, the lamp body 10 can swing along the rotational axis L1 or L2, i.e., in two different rotational orientations.

In some examples, the swing axes L1 and L2 are orthogonal to each other when both the flexible connectors 22 and 23 are applied by the lamp base 100.

In one example, both the flexible connectors 22 and 23 clamp the lamp body 10. Such that a friction force is generated between the ring frame 20 and the lamp body 10 when the ring frame 20 rotates relative to the lamp body 10 along the rotational axis R. Also, the friction force may stop the ring frame 20 from rotating relative the lamp body 10 along the rotational axis R when the friction force reaches its limit.

In one example, the ring body 21 forms a friction force or a clamp force with the circular sidewall 32 for stopping the ring body 21 from relatively rotating with the circular sidewall 32 when the friction force reaches its limit.

In one example, the at least two flexible connectors 22 and 23 are integrated with the ring body 21. Such that the ring frame 20 forms an integral structure and has better stability.

FIG. 2 illustrates a split diagram of the lamp body 10 according to one example of the present invention. The lamp body 10 includes an upper part 11, a middle part 12, a lower part 13, a lampshade 14, a circuit board 15 and the illuminating component 16. The illuminating component 16 extends from the upper part 11. The lower part 13 supports the upper part 11. The middle part 12 is sandwiched between the upper part 11 and the lower part 13. Also, the middle part 12 is supported by the lower part 13. The lampshade 14 is installed within the middle part 12. In addition, the lampshade 14 covers the illuminating component 16. Such that the lampshade 14 reflects part of illuminance emitted from the illuminating component 16. The circuit board 15 is installed within the lampshade 14. Besides, the circuit board 15 is electrically coupled to the illuminating component 16 for driving the illuminating component 16.

In some examples, the upper part 11, the lower part 13, and the middle part 12 are coupled to each other via a snap fit, a threaded fit, an interference fit, a tongue-and-groove fit, a post-and-bore fit, or a press fit. Also, the utilized fasteners for coupling the upper part 11, the lower part 13, and the middle part 12 may include screws.

In some examples, the illuminating component 16 is implemented using at least one light emitting diode.

FIG. 3 illustrates a split diagram of the lamp base 100 according to one example of the present invention. In some examples, each of the at least two flexible connectors 22 and 23 includes a through hole, i.e., a through hole 221 or 231. Also, the lamp body 10 includes affixation holes 131 respectively corresponding to each of the through holes 221 and 231. In addition, the lamp base 100 utilizes at least one fastener, e.g., screws 25, for detachably affixing themselves to corresponding affixation hole 131 and a corresponding through hole 221 or 231, e.g., to form a screw engagement. Such that a swing angle of the lamp body 10 along a swing axis L1 or L2 is adjustable. It is noted that each the swing axis L1 or L2 passes through two flexible connectors in a straight line. In some examples, the circular sidewall 32 may also include at least one receiving hole 321 for receiving the fasteners, for the purpose of better stability of the lamp base 100.

In some examples, the utilized at least one fasteners are integrated with the lamp body 10 for better stability.

In some examples, the utilized at least one fasteners form an interference fit with the corresponding affixation holes 131 and the corresponding through holes 221 or 231.

In some example, the at least one affixation hole 131 is disposed at the lower part 13.

In some examples, the lamp body 10 includes at least one rotation limiter 17. The at least one rotation limiter 17 abuts a corresponding flexible connector 22 or 23 for limiting a relative rotation between the ring frame 20 and the lamp body 10.

FIG. 3 and FIG. 5 also illustrates exemplary details of the at least one rotation limiter 17. In one example, the rotation limiter 17 is disposed on the lower part 13. When the ring frame 20 rotates relatively to the lamp body 10 for a certain angle, the rotation limiter 17 abuts the flexible connector 22 or 23, such that the ring frame 20 cannot rotate further. That is, the relative rotation of the ring frame 20 to the lamp body 10 is thus limited. In this way, the ring frame 20 can be prevented from damaging the ring body 21 by over-rotating itself relatively to the amp body 10.

The number of utilized rotation limiter 17 is variable with respect to the amount of used flexible connectors of the ring frame 20, according to various examples.

As shown in FIGS. 3 and 5, the rotation limiter 17 includes a frontside projection 171 and a backside projection 172, which are disposed at opposite sides of the flexible connector 22 or 23. The frontside projection 171 and the backside projection 172 limit the lamp body 10's swing (or rotational) movement relatively to the ring frame 20 along the swing axis L1 or L2 in a clockwise or counterclockwise manner.

In one example, a distance between the frontside projection 171 and the backside projection 172 is determined according to a desired swing or rotational range of the lamp body 10 relative to the ring frame 20. In this way, the lamp body 10 will not damage other components of the lamp base 100. In some examples, a range of the desired swing angle may be 60 or 90 degrees along the swing axis L1 or L2.

In some examples, the frontside projection 171 and the backside projection 172 share a same geometric form, such as pillar-formed. In addition, in some examples, either one of the frontside projection 171 and the backside projection 172 has a cross section that abuts the flexible connector 22 or 23. In one example, the cross sections of the frontside projection 171 and the backside projection 172 share a same geometric form, such as circular or rectangular. Also, either one of the frontside projection 171 and the backside projection 172 may have a lateral section that face circumferentially outwards the lamp base 100 and share a same geometric form.

In some examples, the lamp base 100 further includes at least one flexible installer 40. The at least one flexible installer 40 are oppositely disposed on the circular sidewall 32. Such that the circumferential projection component 30 can be better fastened onto an external surface, i.e., the ceiling. In some examples, the lamp base 40 utilizes two symmetrically-disposed flexible installers 40 for improving the lamp base 100's balance and stability.

In some examples, the at least one flexible installer 40 is implemented using torsion springs.

In some examples, the lamp base 100 further includes a fastener plate 41. The fastener plate 41 affixes the at least one flexible installer 40 into the circular sidewall 32 via a snap fit, a threaded fit, an interference fit, a tongue-and-groove fit, a post-and-bore fit, or a press fit.

Figure 7:
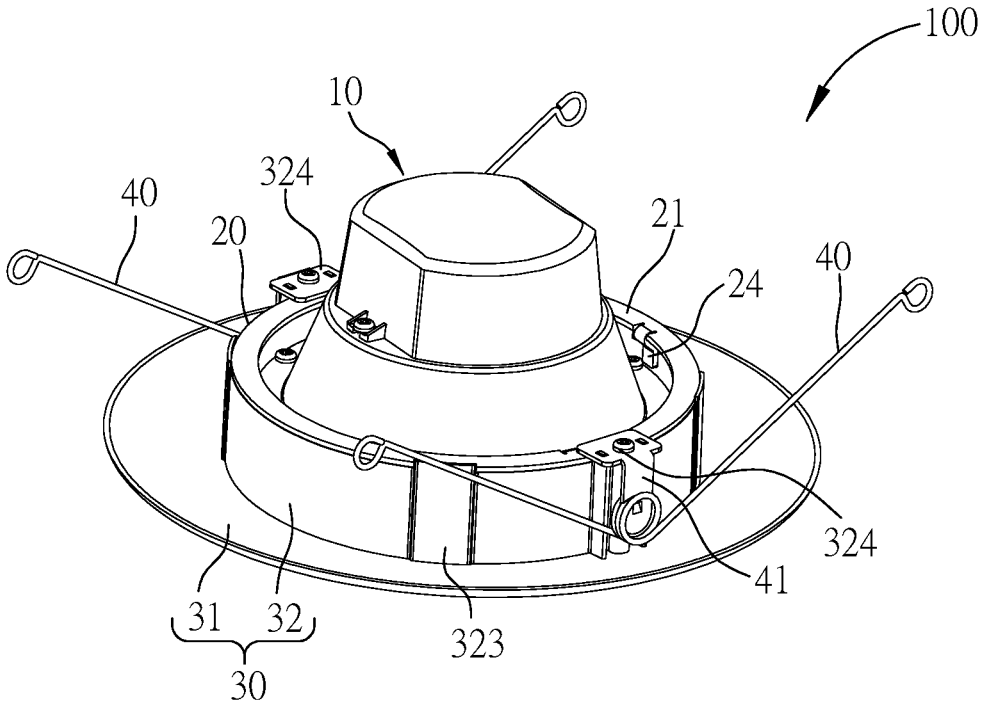
FIG. 7 illustrates a stereogram of the lamp base according to a second embodiment of the present invention.
Figure 8:
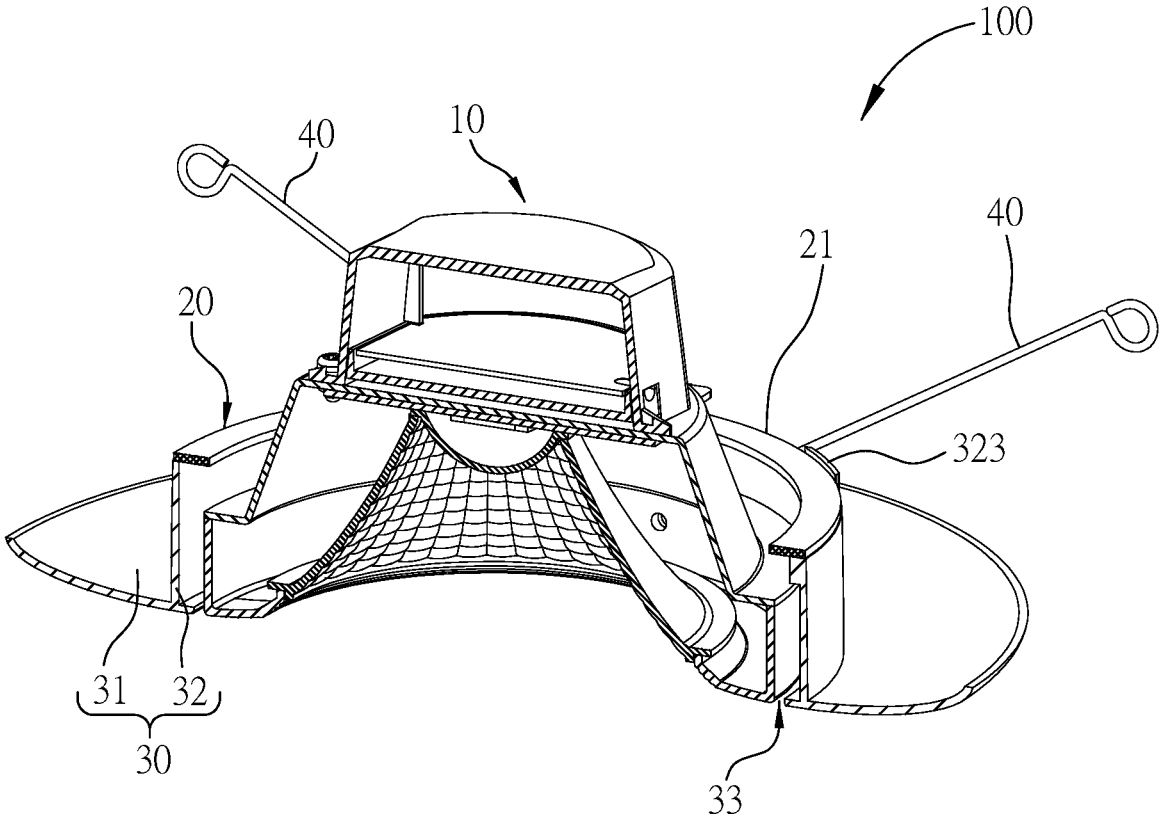
FIG. 8 illustrates a perspective diagram of the lamp base shown in FIG. 7.
Figure 9:
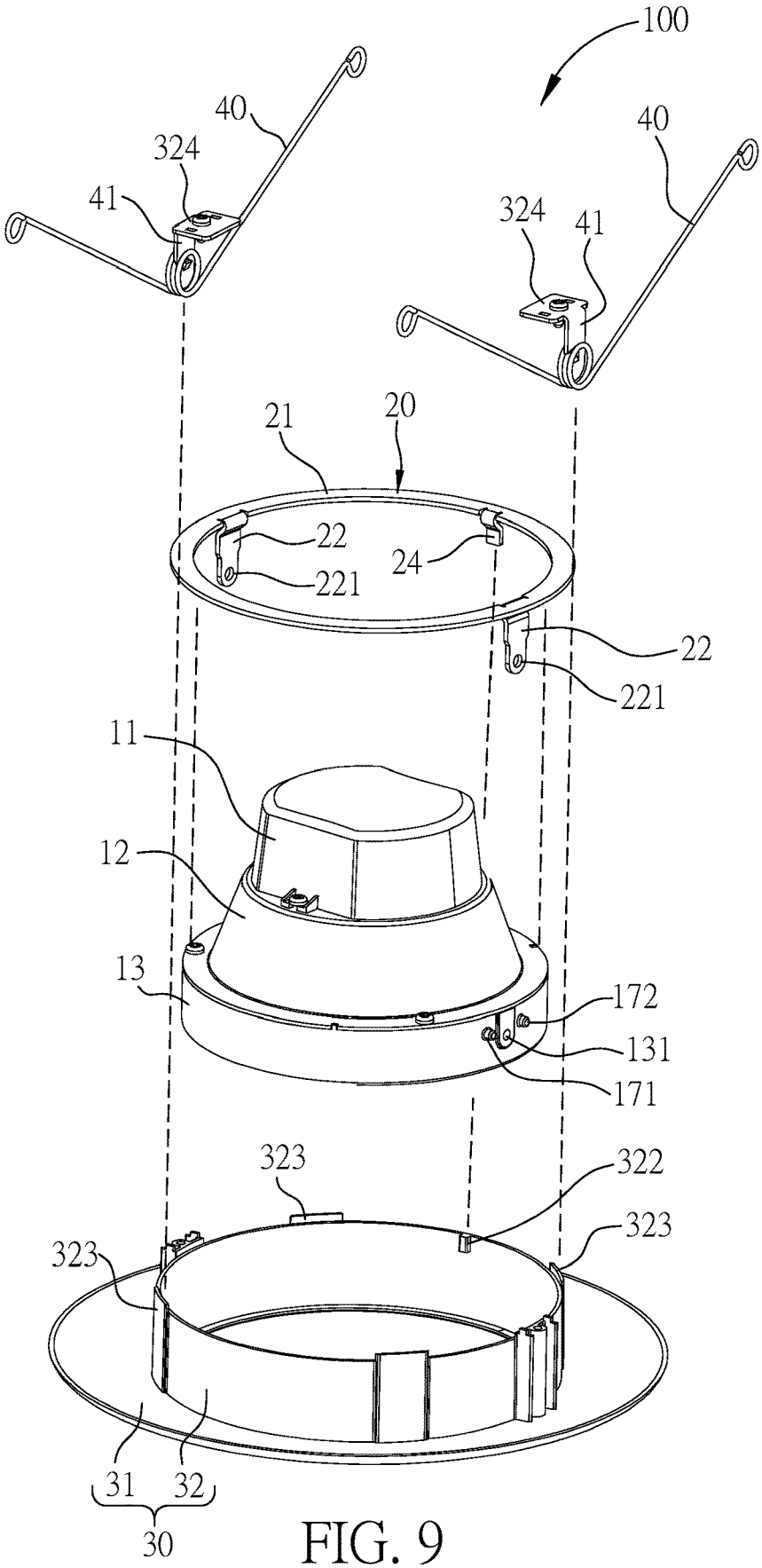
FIG. 9 illustrates a split diagram of the lamp base shown in FIG. 7.
Figure 10:
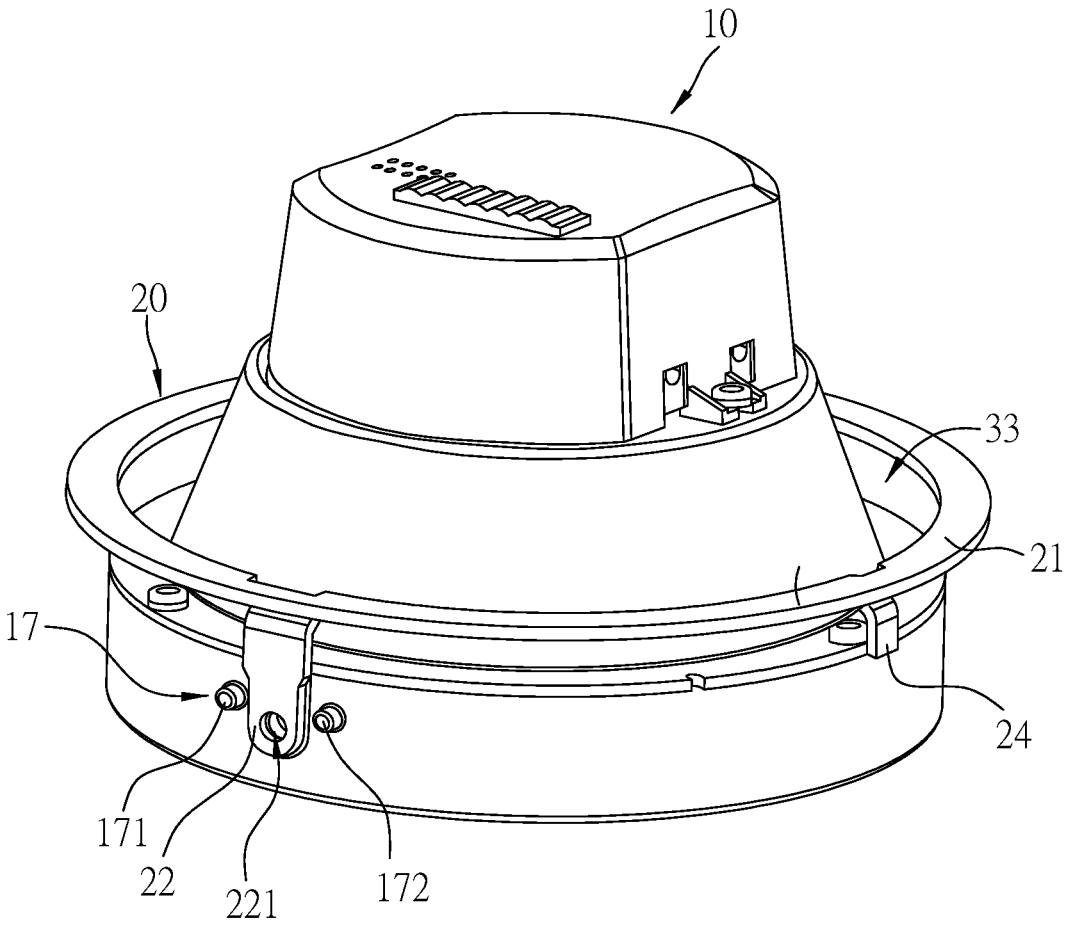
FIG. 10 illustrates a more detailed diagram of the lamp base with respect to that of FIG. 7.
Figure 11:
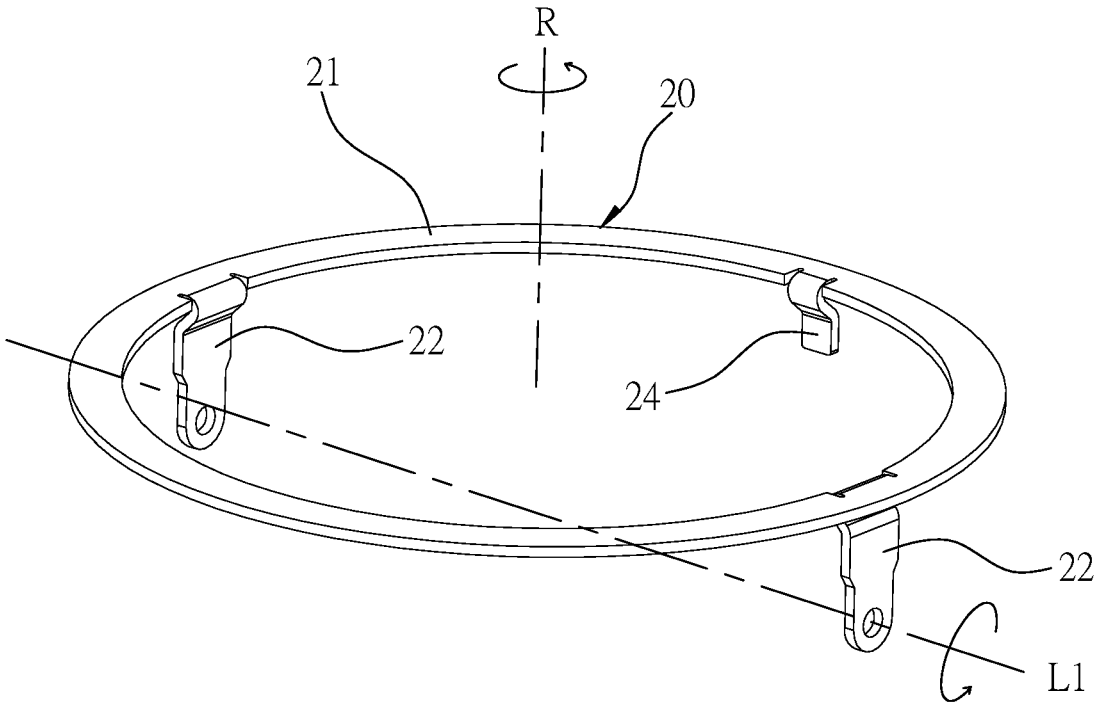
FIG. 11 illustrates exemplary swing movement of the ring frame shown in FIG. 7 relatively to the lamp body shown in FIG. 7.

FIGS. 7-11 illustrates the lamp base 100 according to a second embodiment of the present invention. Similarly, FIG. 7 illustrates a stereogram of the lamp base 100. FIG. 8 illustrates a perspective diagram of the lamp base 100. FIG. 9 illustrates a split diagram of the lamp base 100. FIG. 10 illustrates a more detailed diagram of the lamp base 100 with respect to that of FIG. 1. FIG. 11 illustrates exemplary swing movement of the ring frame 20 relatively to the lamp body 10.

In the second embodiment, the ring frame 20 does not include flexible connectors 22 or 23. Also, the ring frame 20 couples to the circular sidewall 32 is a different manner from the first embodiment.

Specifically, in the second embodiment, the ring frame 20 includes the ring body 21 and a blocker 24. The blocker 24 is disposed a perimeter of the ring body 21. Similar as the first embodiment, the circumferential projection component 30 also has the circular sidewall 32 and the ring projection 31. However, the circular sidewall 32 has another blocker 322 disposed in its internal side and on its perimeter. On top of that, the ring body 21 is rotatably and detachably engaged with the circular sidewall 32. When the ring body 21 rotates relatively to the circular sidewall 32 along the rotational axis R, the blocker 24 abuts the blocker 322 for blocking the relative rotation between the ring body 21 and the circular sidewall 32. Such that a rotational angle of the relative rotation can be limited.

Similarly, in one example, the lamp body 10 and the circular sidewall 32 form a gap 33 in between. Such that the ring body 21 may rotate relatively to the circular sidewall 32 about a rotational range of nearly 360 degrees.

In one example, the ring body 21 and the circular sidewall 32 generate a friction force in between when the ring body 21 rotates relatively to the circular sidewall 32. Such that the relative rotation in between can be better limited and controlled.

In one example, the circumferential projection component 30 includes at least three lateral blockers 323. The at least three lateral blockers 323 are disposed on the perimeter of the circular sidewall 32. Also, the at least three lateral blockers 323 fix an orthogonal center line of the ring body 32 to stay aligned with the rotational axis R. Therefore, the ring body 21 can be substantially avoided from deviating from the rotational axis R to improve the lamp base 100's stability while the ring body 21 rotates relatively to the circular sidewall 32. In one example, the circumferential projection component 30 includes four symmetrically-disposed lateral blockers 323 for improving the lamp base 100's stability.

In one example, the circumferential projection component 30 includes at least two vertical blockers 324. The vertical blockers 324 are disposed above the ring body 21. Also, the vertical blockers 324 block the ring body 21 from moving along the rotational axis R.

Similarly, the lamp base 100 may also include a fastener plate 41 for affixing the vertical blockers 324. In some examples, the fastener 41 affixes the vertical blockers 324 via a snap fit, a threaded fit, an interference fit, a tongue-and-groove fit, a post-and-bore fit, or a press fit. In some examples, the fastener 41 integrates with the vertical blockers 324 for such affixation.

The swing movement of the ring frame 20 with respect to the lamp body 10 is as shown in FIG. 11 while applying the blocker 24. The swing features are similar as those described in FIG. 6. So, the repeated features are not further described for brevity.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lamp base for a downlight with adjustable illumination angle, comprising:

a lamp body, comprising an illuminating component;

a ring frame, configured to surround the lamp body such that the lamp body seated within the ring frame, and configured to rotate relative to the lamp body along a rotational axis of the lamp base; and a circumferential projection component, having an inner circular through hole to allow the lamp body to pass through, wherein the circumferential projection component is configured to detachably and rotatably engage with the ring frame;

wherein the lamp body is configured to rotate relative to at least one of the ring frame and the circumferential projection component along the rotational axis, so as to adjust an illumination angle of the illuminating component, wherein the ring frame comprises:

a ring body;

a first flexible connector, coupled to the ring body at a perimeter of the ring frame; and a second flexible connector, coupled to the ring body at the perimeter of the ring frame and opposite to the first flexible connector; and wherein the circumferential projection component comprises:

a circular sidewall, which forms the inner circular through hole and stands along the rotational axis; and a ring projection, which extends circumferentially from the circular sidewall;

wherein both the first flexible connector and the second flexible connector are configured to detachably and rotatably engage with the lamp body;

wherein the ring body is configured to rotatably and detachable engaged with the circular sidewall; and wherein the lamp body is further configured to rotate relative to at least one of the circular sidewall and both the first flexible connector and the second flexible connector for adjusting the illumination angle.

2. The lamp base of claim 1, wherein the lamp body and the circular sidewall form a gap in between.

3. The lamp base of claim 1, wherein both the first flexible connector and the second flexible connector are further configured to clamp the lamp body, such that a friction force is generated between the ring frame and the lamp body when the ring frame rotates relative to the lamp body along the rotational axis.

4. The lamp base of claim 3, wherein both the first flexible connector and the second flexible connector are further configured to stop the ring frame from rotating relative the lamp body along the rotational axis using the friction force.

5. The lamp base of claim 1, wherein the ring body is further configured to form a friction force or a clamp force with the circular sidewall for stopping the ring body from relatively rotating with the circular sidewall.

6. The lamp base of claim 1, wherein both the first flexible connector and the second flexible connector are integrated with the ring body, such that the ring frame forms an integral structure.

7. The lamp base of claim 1, wherein each of the first flexible connector and the second flexible connector comprises a through hole;

wherein the lamp body further comprising at least one affixation hole respectively corresponding to each the through hole of the first flexible connector and the second flexible connector;

wherein the lamp base further comprises at least one fastener corresponding to each of the affixation hole and each of the through hole; and wherein each of the at least one fastener is configured to detachably affix to a corresponding affixation hole or a corresponding through hole such that a swing angle of the lamp body along a swing axis extended from a straight line between the first flexible connector and the second flexible connector is adjustable.

8. The lamp base of claim 7, wherein the at least one fastener comprises at least one screw;

wherein the at least one affixation hole comprises at least one screw receiving hole; and wherein the at least one screw is configured to screw into the at least one screw receiving hole to form a screw engagement between the lamp body and the first flexible connector or the second flexible connector.

9. The lamp base of claim 7, wherein the at least one fastener is integrated with the lamp body.

10. The lamp base of claim 7, wherein each of the at least one fastener is further configured to detachably affix to the corresponding affixation hole and the corresponding through hole via an interference fit.

11. The lamp base of claim 7, wherein the at least one affixation hole is disposed at a lower part of the lamp body.

12. The lamp base of claim 7, wherein the lamp body further comprises at least one rotation limiter, which is configured to abut the first flexible connector or the second flexible connector for limiting a relative rotation between the ring frame and the lamp body.

13. The lamp base of claim 12, wherein each of the at least one rotation limiter comprises a frontside projection and a backside projection;

wherein the frontside projection is configured to limit the relative rotation between the ring frame and the lamp body in a clockwise manner or in a counterclockwise manner; and wherein the backside projection is configured to limit the relative rotation between the ring frame and the lamp body in an opposite manner to that of the frontside projection.

14. The lamp base of claim 13, wherein a distance between the frontside projection and the backside projection is determined according to a desired rotational range of the lamp body relative to the ring frame.

15. The lamp base of claim 13, wherein the frontside projection and the backside projection shares a same geometric form.

16. The lamp base of claim 15, wherein both the frontside projection and the backside projection are pillar-formed.

17. The lamp base of claim 13, wherein the frontside projection comprises a first cross section, configured to abut the first flexible connector or the second flexible connector; and wherein the backside projection comprises a second cross section, configured to abut the first flexible connector or the second flexible connector.

18. The lamp base of claim 17, wherein the first cross section and the second cross section share a same geometric form.

19. The lamp base of claim 18, wherein both the first cross section and the second cross section are circular or rectangular.

20. The lamp base of claim 1, wherein the ring frame further comprises:

a third flexible connector, coupled to the ring body at the perimeter of the ring frame; and a fourth flexible connector, coupled to the ring body at the perimeter of the ring frame and opposite to the third flexible connector;

wherein a first straight line that links the first flexible connector and the second flexible connector is substantially orthogonal to a second straight line that links the third flexible connector and the fourth flexible connector; and wherein both the third flexible connector and the fourth flexible connector are configured to detachably engage with the circular sidewall, such that the ring frame rotatably and detachably engages with the circumferential projection component.

21. The lamp base of claim 20, wherein both the third flexible connector and the fourth flexible connector are further configured to clamp the circular sidewall for rotatably and detachably engaging the ring frame with the circular sidewall.

22. The lamp base of claim 20, wherein each of the third flexible connector and the fourth flexible connector comprises a through hole;

wherein the lamp body further comprising at least one affixation hole respectively corresponding to each the through hole of the third flexible connector and the fourth flexible connector;

wherein the lamp base further comprises at least one fastener corresponding to each of the affixation hole and each of the through hole; and wherein each of the at least one fastener is configured to detachably affix to a corresponding affixation hole and a corresponding through hole such that a swing angle of the lamp body along a swing axis extended from the second straight line is adjustable.

23. The lamp base of claim 22, wherein the at least one fastener comprises at least one screw;

wherein the at least one affixation hole comprises at least one screw receiving hole; and wherein the at least one screw is configured to screw into the at least one screw receiving hole to form a screw engagement between the lamp body and the third flexible connector or the fourth flexible connector.

24. The lamp base of claim 22, wherein the at least one fastener is integrated with the lamp body.

25. The lamp base of claim 22, wherein each of the at least one fastener is further configured to detachably affix to the corresponding affixation hole and the corresponding through hole via an interference fit.

26. The lamp base of claim 22, wherein the lamp body further comprises at least one rotation limiter, which is configured to abut the third flexible connector or the fourth flexible connector for limiting a relative rotation between the ring frame and the lamp body.

27. The lamp base of claim 26, wherein each of the at least one rotation limiter comprises a frontside projection and a backside projection;

wherein the frontside projection is configured to limit the relative rotation between the ring frame and the lamp body in a clockwise manner or in a counterclockwise manner; and wherein the backside projection is configured to limit the relative rotation between the ring frame and the lamp body in an opposite manner to that of the frontside projection.

28. The lamp base of claim 27, wherein a distance between the frontside projection and the backside projection is determined according to a desired rotational range of the lamp body in relative to the ring frame.

29. The lamp base of claim 27, wherein the frontside projection and the backside projection shares a same geometric form.

30. The lamp base of claim 29, wherein both the frontside projection and the backside projection are pillar-formed.

31. The lamp base of claim 27, wherein the frontside projection comprises a first cross section, configured to abut the third flexible connector or the fourth flexible connector;

wherein the backside projection comprises a second cross section, configured to abut the third flexible connector or the fourth flexible connector.

32. The lamp base of claim 27, wherein the first cross section and the second cross section share a same geometric form.

33. The lamp base of claim 32, wherein both the first cross section and the second cross section are circular or rectangular.

34. A lamp base for a downlight with adjustable illumination angle, comprising:

a lamp body, comprising an illuminating component;

a ring frame, configured to surround the lamp body such that the lamp body seated within the ring frame, and configured to rotate relative to the lamp body along a rotational axis of the lamp base; and a circumferential projection component, having an inner circular through hole to allow the lamp body to pass through, wherein the circumferential projection component is configured to detachably and rotatably engage with the ring frame;

wherein the lamp body is configured to rotate relative to at least one of the ring frame and the circumferential projection component along the rotational axis, so as to adjust an illumination angle of the illuminating component, wherein the lamp body further comprises:

an upper part, from which the illuminating component extends;

a lower part, configured to support the upper part;

a middle part, sandwiched between the upper part and the lower part and supported by the lower part;

a lampshade, installed within the middle part, wherein the lampshade is configured to cover the illuminating component, such that the lampshade reflects part of illuminance emitted from the illuminating component; and a circuit board, installed within the lampshade and electrically coupled to the illuminating component for driving the illuminating component.

35. The lamp base of claim 34, wherein the upper part, the lower part, and the middle part are further configured to coupled with each other via one of a snap fit, a threaded fit, an interference fit, a tongue-and-groove fit, a post-and-bore fit, and a press fit.

36. A lamp base for a downlight with adjustable illumination angle, comprising:

a lamp body, comprising an illuminating component;

a ring frame, configured to surround the lamp body such that the lamp body seated within the ring frame, and configured to rotate relative to the lamp body along a rotational axis of the lamp base; and a circumferential projection component, having an inner circular through hole to allow the lamp body to pass through, wherein the circumferential projection component is configured to detachably and rotatably engage with the ring frame;

wherein the lamp body is configured to rotate relative to at least one of the ring frame and the circumferential projection component along the rotational axis, so as to adjust an illumination angle of the illuminating component, wherein the ring frame comprises:

a ring body;

a first flexible connector, coupled to the ring body at a perimeter of the ring frame; and a second flexible connector, coupled to the ring body at the perimeter of the ring frame and opposite to the first flexible connector; and wherein the circumferential projection component comprises:

a circular sidewall, which forms the inner circular through hole and stands along the rotational axis; and a ring projection, which extends circumferentially from the circular sidewall:

wherein both the first flexible connector and the second flexible connector are configured to detachably and rotatably engage with the lamp body;

wherein the ring body is configured to rotatably and detachable engaged with the circular sidewall; and wherein the lamp body is further configured to rotate relative to at least one of the circular sidewall and both the first flexible connector and the second flexible connector for adjusting the illumination angle, the lamp base further comprising:

at least one flexible installer, oppositely disposed on the circular sidewall for fastening the circumferential projection component onto an external surface.

37. The lamp base of claim 36, further comprising:

a fastener plate, configured to affix the at least one flexible installer into the circular sidewall via one of a snap fit, a threaded fit, an interference fit, a tongue-and-groove fit, a post-and-bore fit, and a press fit.

38. A lamp base for a downlight with adjustable illumination angle, comprising:

a lamp body, comprising an illuminating component;

a ring frame, configured to surround the lamp body such that the lamp body seated within the ring frame, and configured to rotate relative to the lamp body along a rotational axis of the lamp base; and a circumferential projection component, having an inner circular through hole to allow the lamp body to pass through, wherein the circumferential projection component is configured to detachably and rotatably engage with the ring frame;

wherein the lamp body is configured to rotate relative to at least one of the ring frame and the circumferential projection component along the rotational axis, so as to adjust an illumination angle of the illuminating component, wherein the ring frame further comprises:

a ring body; and a first blocker, disposed a perimeter of the ring body;

wherein the circumferential projection component comprises:

a circular sidewall, above which the ring body is disposed, the circular sidewall comprises a second blocker disposed internally on a perimeter of the circular sidewall; and a ring projection, which extends circumferentially from the circular sidewall;

wherein the ring body is configured to rotatably and detachably engaged with the circular sidewall;

wherein a relative rotation between the ring body and the circular sidewall along the rotational axis is blocked when the first blocker abuts the second blocker during the relative rotation.

39. The lamp base of claim 38, wherein the lamp body and the circular sidewall form a gap in between.

40. The lamp base of claim 38, wherein the ring body and the circular sidewall are configured to generate a friction force in between when the ring body rotates relatively to the circular sidewall.

41. The lamp base of claim 38, wherein the circumferential projection component further comprises:

at least three lateral blockers, disposed on the perimeter of the circular sidewall, and configured to fix an orthogonal center line of the ring body to stay aligned with the rotational axis.

42. The lamp base of claim 38, wherein the circumferential projection component further comprises:

at least two vertical blockers, disposed above the ring body and configured to block the ring body from moving along the rotational axis.

43. The lamp base of claim 42, further comprising:

a fastener plate, configured to affix the at least two vertical blockers into the circular sidewall via one of a snap fit, a threaded fit, an interference fit, a tongue-and-groove fit, a post-and-bore fit, and a press fit.

44. The lamp base of claim 42, further comprising:

a fastener plate, configured to affix the at least two vertical blockers into the circular sidewall by integrating with the at least two vertical blockers.

* * * * *